US005112447A

United States Patent [19]

Gestaut et al.

[11] Patent Number: 5,112,447

[45] Date of Patent: May 12, 1992

[54] PROCESS FOR ELECTROPLATING

[75] Inventors: Lawrence J. Gestaut, Chagrin Falls; James R. Brannan, Perry; Anthony J. Vaccaro, Mentor, all of Ohio; Donald J. Groszek, Sugar Land, Tex.

[73] Assignee: ELTECH Systems Corporation, Boca Raton, Fla.

[21] Appl. No.: 746,550

[22] Filed: Aug. 19, 1991

[51] Int. Cl.[5] ..... C25D 21/00

[52] U.S. Cl. ..... 205/148; 204/115; 205/305

[58] Field of Search ..... 204/14.1

[56] References Cited

U.S. PATENT DOCUMENTS 4,234,401 11/1980 Brannan ..... 204/149

4,906,340 3/1990 Brown ..... 204/14.1

*Primary Examiner*—T. M. Tufariello

*Attorney, Agent, or Firm*—John J. Freer

[57] ABSTRACT

In the electroplating of certain metals, such as zinc, a metal build-up in the electroplating bath occurs due to a higher anode efficiency than cathode efficiency, in the cell, and also due to chemical dissolution of the anode in the electroplating bath. An electrowinning cell is provided to remove metal from the electroplating bath. The electrowinning cell is operated with a current sufficient to remove metal from the bath substantially equal to that chemically dissolved into the bath as well as the build-up due to the difference in the anodic and cathodic efficiencies.

4 Claims, 1 Drawing Sheet

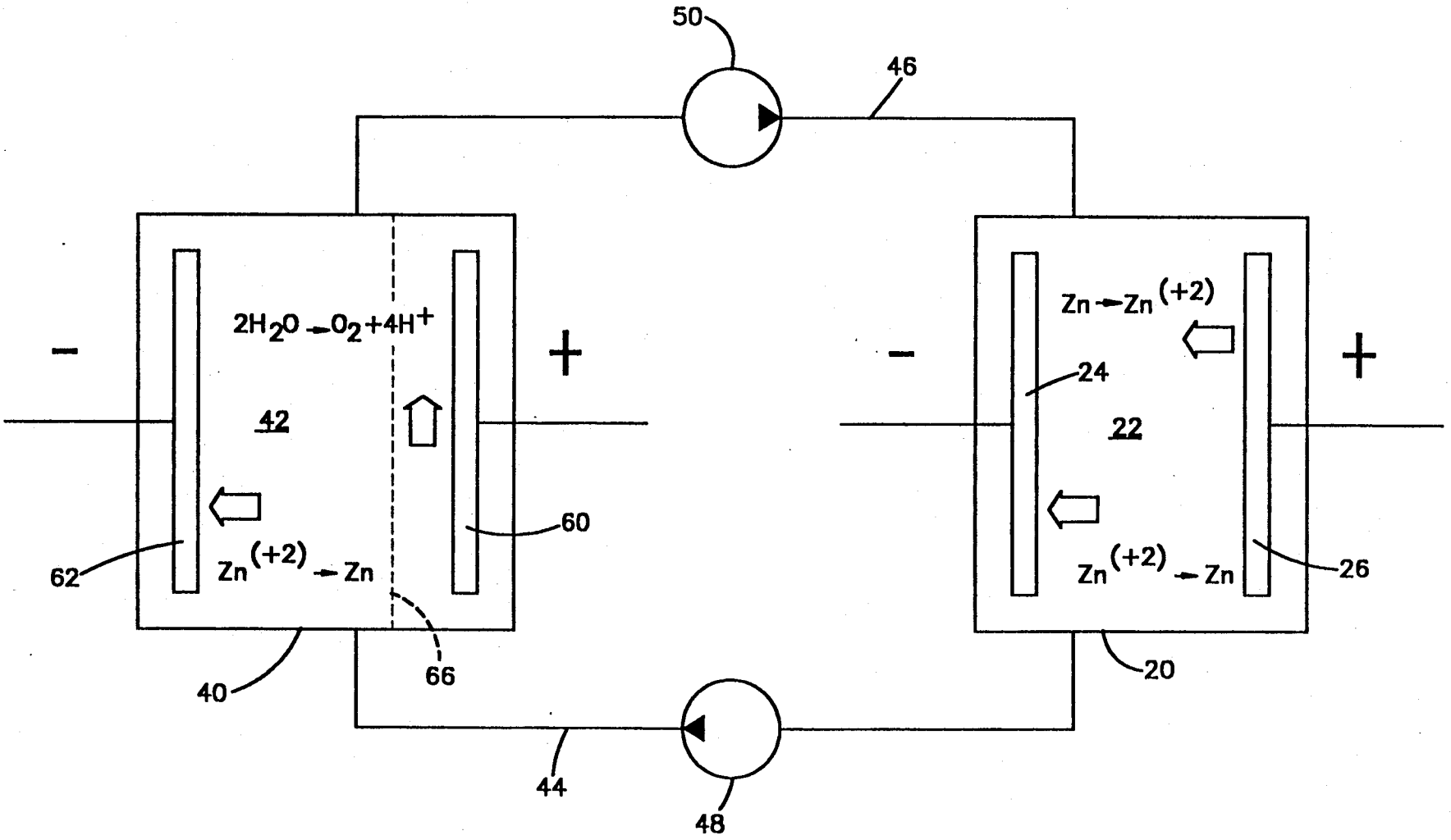
+
26
Zn → Zn(+2)
22
Zn(+2) → Zn
20
24
46
−
50
48
+
60
44
66
2H2O → O2+4H+
42
Zn(+2) → Zn
40
62
−

PROCESS FOR ELECTROPLATING

BACKGROUND OF THE INVENTION

1. Technical Field

The present invention relates to a process for electroplating metals, and particularly to an electroplating process in which a build-up of metal occurs in the electroplating bath. The build-up can be due to (i) a current efficiency of the electroplating cell anode greater than the current efficiency of the electroplating cell cathode, and (ii) chemical dissolution or corrosion of the electroplating cell anode in the plating solution.

2. Description of the Prior Art

U.S. Pat. No. 4,906,340, issued Mar. 6, 1990, discloses a process for electroplating metals. The process employs an electroplating cell comprising a bath containing a plating solution of a metallic salt, a cathode comprising a workpiece to be plated, and a soluble anode. The anode current efficiency of the cell is greater than the cathode current efficiency. This causes more metal to dissolve from the anode than is plated at the cathode, in turn causing a build-up of dissolved metal in the electroplating cell. The current that is not used for plating at the cathode generates hydrogen in the cell.

The process includes the steps of providing an electrowinning cell which includes at least one insoluble anode, at least one insoluble cathode, and a bath which communicates with the bath of the electroplating cell. The plating solution is circulated between the electroplating cell and the electrowinning cell.

A source of direct current is connected across the anode and cathode of the electrowinning cell so as to cause depletion of the metal from the plating solution onto the electrowinning cell cathode. The amount of current in the electrowinning cell is controlled to be at least substantially equal to the amount of current flowing through the electroplating cell which results in the generation of hydrogen.

The patent discloses the following equation for calculating the amount of current $I_w$ (amp.) to use in the electrowinning cell:

$$I_w = \frac{\left(1 - \frac{E_p}{100}\right) I_p}{\frac{E_w}{100}} \quad (1)$$

wherein $E_p$=cathode efficiency in electroplating cell (%)

$E_w$=cathode efficiency in electrowinning cell (%)

$I_p$=current in electroplating cell (amp.)

In certain electroplating processes, for instance the electrogalvanizing process, it has been found that the apparent anode current efficiency in the electroplating cell is much greater than 100% due to significant chemical dissolution or corrosion of the anode in addition to electrochemical dissolution of the anode. This means that in such processes, if the electrowinning cell is operated at a current at least substantially equal to the current flowing through the electroplating cell which results in the generation of hydrogen, the concentration of the metal in the plating solution will continue to rise due to the chemical dissolution. In the case of electrogalvanizing, by way of example, this build-up due to chemical dissolution can be substantial.

The patent is also based on the assumption that the current efficiency of the anode is 100%, which is why the value "1" appears in the above equation (1). In plating with zinc, for instance in electrogalvanizing, the anode efficiency in the electroplating cell is at least close to 100%, and the assumption is reasonable. However, when plating with other metals, such as nickel, when the chloride ion concentration is too low, or other soluble anodes when the anode current density is too high, the anode efficiency in the electroplating cell may be less than 100%. Thus, application of the above equation to an electrowinning process, where the anode in the electroplating cell is a metal having an efficiency ($E_p$) less than 100%, will give too high a value for $I_w$. This in turn will result in a depletion of metal in the electroplating bath (assuming no dissolution of the electroplating anode).

SUMMARY OF THE INVENTION

The present invention resides in a process for electroplating metals in an electroplating cell comprising a bath containing a plating solution of a metallic salt, a cathode comprising a workpiece to be plated, and a soluble anode. The anode has a current efficiency which is greater than the cathode current efficiency. The anode is also chemically soluble in the electroplating solution. The process includes the steps of (i) providing an electrowinning cell which includes at least one insoluble anode, at least one cathode and a bath comprising said plating solution which communicates with the bath of the electroplating cell; (ii) circulating the plating solution between the two cells; (iii) connecting a source of direct electric current to the anode and cathode of the electroplating cell so as to cause electroplating of metal onto the workpiece; (iv) connecting a second source of direct current across the anode and cathode of the electrowinning cell so as to cause the deposition of metal from the plating solution onto the cathode of the electrowinning cell; and (v) controlling the current $I_w$ in the electrowinning cell to compensate for (a) the difference in current efficiencies between the anode and cathode in the electroplating cell and (b) the chemical dissolution of the anode in the electroplating cell.

More specifically, the current $I_w$ (amp.) in the electrowinning cell is controlled in accordance with the following equations:

$$I_w = \frac{[I_p \times (E_e - E_p)] + I_c}{E_w} \quad (2)$$

wherein:

$I_p$=current (amp.) in the electroplating cell;

$E_e$=anodic efficiency in the electroplating cell;

$E_p$=cathodic efficiency in the electroplating cell;

$E_w$=cathodic efficiency in the electrowinning cell; and $I_c$=theoretical current (amp.) required in the electrowinning cell to remove from the electroplating bath metal dissolved due to chemical corrosion of the anode in the electroplating bath.

In equation (2) the values $E_e$, $E_p$ and $E_w$ are expressed in decimal fractions.

The value $I_c$ can be determined from the following equation:

$$I_c = \frac{G_{me}}{T} \times \frac{n \times F}{MW} \quad (3)$$

wherein:

$G_{me}/T$ = grams of metal dissolved due to chemical corrosion of the anode in the electroplating cell per second n = valence of the metal F = Faraday's constant MW = Molecular weight of the metal dissolved.

BRIEF DESCRIPTION OF THE DRAWINGS

Further features of the present invention will become apparent to those skilled in the art to which the present invention relates from reading the following specification with reference to the accompanying drawing, in which the FIGURE is a schematic illustration of an apparatus for performing the process of the present invention.

DESCRIPTION OF PREFERRED EMBODIMENT

For the purposes of the present application, the term "current efficiency" means the ratio of the useful current transferred between an electrode and the electrolyte, in which the electrode is immersed, to the current supplied to the electrode.

Referring to the drawing, the FIGURE illustrates an apparatus for continuously plating a metal substrate. The present invention is particularly applicable to galvanizing wherein zinc is chemically dissolved in an electrolyte at a relatively rapid rate. However, the present invention is also applicable to other plating processes wherein the anode is dissolved in the electrolyte, for instance cadmium plating with excess free cyanide ion, or tin in an acid tin bath.

The apparatus comprises an electroplating cell 20. The cell 20 holds a bath 22 containing a plating solution of a metallic salt (e.g., a zinc salt). In the galvanizing process, the bath 22 is preferably a zinc chloride bath, although the use of a zinc sulfate bath is also contemplated. Also, in the galvanizing process, typically steel strip to be plated, shown schematically as cathode 24, is continuously conveyed through the electroplating bath 22. The cell 20 also contains a soluble metal anode 26 (e.g., of zinc or zinc alloy), immersed in the bath 22.

A cathodic charge is imparted to the travelling meta strip (cathode 24) by connecting a source of direct electric current between the cathode 24 and the anode 26, as indicated. As is well known, metal from the bath 22 is deposited onto the strip (cathode 24) as it travels through the bath due to the current flow between the cathode 24 and the anode 26. At the same time, metal is dissolved from anode 26 into the bath due to the current flow.

Normally, the current efficiency of the anode 26 is greater than the current efficiency of the cathode 24. In the case of an electrogalvanizing cell, by way of example, wherein the anode 26 is zinc and the cathode 24 is steel, the anode may have a current efficiency of near 100%, whereas the cathode may have a current efficiency of only about 97%. This means that the anode 26 will be electrochemically dissolved into the plating bath 22 at a rate faster than the rate at which the metal is plated from the bath onto the cathode 24. This will result in a build-up of the plating metal in the plating bath.

The anodic efficiency in the electroplating cell is not always near 100%. For some metals, for instance at high current density, the anodic efficiency may be 99% or less, reducing the difference between the amount of metal electrochemically dissolved from the anode 26 and the amount of metal electrochemically plated on the cathode 24, in turn reducing or offsetting somewhat the build-up of the plating metal in the plating bath due to the electrochemical dissolution of the anode in the plating bath.

In addition to the build-up of metal in the plating bath due to electrochemical action in the cell 20, a build-up occurs due to the chemical dissolution or corrosion of the anode 26 in the electroplating bath 22. The chemical dissolution or corrosion will occur even if no electric current is flowing in the cell 20. In the case of electrogalvanizing, using a zinc chloride solution for bath 22, and a zinc anode 26, this chemical dissolution or corrosion will occur at a relatively rapid rate, and will significantly add to the build-up of metal, e.g., zinc, in the bath 22 already occurring from the electrochemical action.

In accordance with the present invention, an electrowinning cell 40 is provided and includes a bath 42. The bath 42 is connected to bath 22 of the electroplating cell by lines 44 and 46 so that plating solution from bath 22 can be circulated through the bath 42 of the electrowinning cell 40. Pumps 48, 50 in lines 44, 46 cause the plating solution to circulate. Such circulation may be continuous, although batch circulation is also contemplated.

The electrowinning cell 40 comprises an insoluble anode 60 and an insoluble cathode 62. A source of direct electric current, separate from the source of electric current for the electroplating cell 20, is connected across the anode 60 and cathode 62. This cause the deposition of metal from the plating solution in bath 42 onto the cathode 62 to occur. The plating solution is circulated between the cells 20 and 40, while the amount of current flowing through the electrowinning cell is controlled so that the rate of metal deposition in the electrowinning cell 40 will be essentially the same as the rate of dissolved metal build-up in the electroplating cell 20. The metal build-up in the electroplating cell 20 is thus counteracted by the depletion of metal in the electrowinning cell 40. It is however to be understood that this counteraction may be assisted, e.g., by the addition of make-up water to the cathode compartment of the electrowinning cell 40.

The cathode 62 of the electrowinning cell may be a sheet of the metal being electroplated (e.g., zinc) or a blank sheet of another metal such as stainless steel, titanium or aluminum, from which metal deposited can be easily stripped. As such, the metal deposited can thus be recovered and re-used as anode material in the electroplating process, or sold to recoup its value.

The anode 60 may be any material which is insoluble in the solution of the electroplating bath, such as graphite, a precious metal coated valve metal, a precious metal coated ceramic material, lead or a lead alloy.

The electrowinning current ($I_w$) required in the electrowinning cell is controlled in accordance with the following equation (2).

$$I_w = \frac{[I_p \times (E_e - E_p)] + I_c}{E_w} \quad (2)$$

wherein:

$I_p$=current (amp.) in the electroplating cell;

$E_e$=anodic efficiency in the electroplating cell;

$E_p$=cathodic efficiency in the electroplating cell;

$E_w$=cathodic efficiency in the electrowinning cell; and $I_c$=theoretical current required in the electrowinning cell as determined by equation (3) to remove from the electroplating bath metal dissolved due to chemical corrosion of the anode in the electroplating bath.

In equation (2) the values $E_e$, $E_p$ and $E_w$ are expressed in decimal fractions.

The value $I_c$ can be determined from the following equation:

$$I_c = \frac{G_{me}}{T} \times \frac{n \times F}{MW} \quad (3)$$

wherein:

$G_{me}/T$=grams of metal dissolved due to chemical corrosion of the anode in the electroplating cell per second n=valence of the metal F=Faraday's constant MW=Molecular weight of the metal dissolved.

EXAMPLE 1

An electroplating cell 20 of the FIGURE is operated with a zinc anode 26 in a zinc chloride bath. The electroplating cell 20 is operated using an external circuit current ($I_p$) of 1,000,000 amps. The electroplating cell has a cathodic efficiency ($E_p$) of 97%, and anodic efficiency ($E_e$) of essentially 100%. The rate of dissolution of zinc in the electroplating cell, due to chemical corrosion, is determined to be about 5 kg/hr.

An electrowinning cell 40 is provided. The electrowinning cell 40 has a cathodic efficiency ($E_w$) of 97%. The theoretical current ($I_c$) required in the electrowinning cell to remove, from the zinc chloride bath, zinc dissolved due to chemical dissolution or corrosion of the anode in the electroplating bath 22, is calculated using equation (3):

$$I_c = \frac{G_{zn}}{T} \times \frac{n \times F}{MW} \quad (3)$$

where:

$G_{zn}/T$=Grams of zinc corroded per second, in this Example, is 1.39 g/sec=5 kg/hr n=valence of zinc=2

F=Faraday's constant=96487 coulombs/equiv.

MW=molecular weight of zinc=65.37 grams/mole

Therefore:

$$I_c = 1.39 \times 2 \times 96487/65.37 = 4100 \text{ amps}$$

If it is desired to leave the value $G_{zn}/T$ in terms of $kg_{zn}/hr$ in calculating $I_c$, the factor n×F/MW, for zinc plating, is 820. Thus equation (3) becomes:

$$I_c = \frac{kg_{zn}}{hr} \times 820 \text{ (amps)}$$

The total current ($I_w$) required in the electrowinning cell to maintain a zinc balance in the zinc chloride bath is calculated, using equation (2):

$$I_w = \frac{[I_p \times (E_e - E_p)] + I_c}{E_W} \quad (2)$$

$$I_w = \frac{[1{,}000{,}000 \times (1.00 - .97)] + 4{,}100}{.97} = \frac{30{,}000 + 4{,}100}{.97} = 35{,}155 \text{ AMPS}$$

If the electrowinning current ($I_w$) is calculated using equation (1), above, the following result is obtained:

$$I_w = \frac{\left(1 - \frac{E_p}{100}\right) I_p}{\frac{E_w}{100}} = \frac{(1.97)\ 1{,}000{,}000}{.97} = 30{,}928 \text{ amps} \quad (1)$$

This means that if the current in the electrowinning cell 40 is adjusted according to equation (1), the adjustment will compensate only for the difference between the current efficiency of the electroplating cell anode 26 and the current efficiency of the electroplating cell cathode 24, and a metal build-up in the bath 22 will continue to take place. Specifically, the metal build-up in the bath due to electrochemical dissolution will be about 38 kg/hr, and that due to chemical corrosion will be, as indicated above, about 5 kg/hr. That means that the actual metal build-up to be compensated for will be about 14% higher than predicted by equation (1).

EXAMPLE 2

This Example illustrates the discrepancy that exists less than 100%. In this Example, the anodic efficiency is 99%. In this Example, no chemical dissolution of the anode 26 is deemed to take place. Otherwise, the same values as in Example 1 are used. Using equation (2) of the present invention, the current $I_w$ is equal to:

$$I_w = \frac{[1{,}000{,}000 \times (.99 - .97)] + 0}{.97} = 20{,}619 \text{ amps}$$

Using equation (1), the value 30,928 amps is obtained. This means that, using equation (1), more metal will be removed from the bath 22 in the electrowinning cell than necessary, and a depletion of metal in bath 22 will occur at a rate of about 12.57 kg/hr.

EXAMPLE 3

This Example illustrates the application of equation (2) of the present invention where both the anode efficiency and chemical corrosion are to be considered. The values of this Example are the same as those of Example 1 except that the anodic efficiency is 99%. Using equation 2, the current $I_w$ is equal to:

$$I_w = \frac{[1{,}000{,}000 \times (.99 - .97)] + 4{,}100}{.97} = 24{,}845 \text{ amps}$$

This is substantially less than the current ($I_w$) required in Example 1, but more than the current ($I_w$) required in Example 2. This Example illustrates that the electrowinning current required in the electrowinning cell 40 may be less due to a less than 100% anode efficiency in the electroplating cell, but that the reduction is offset by the addition of metal to the bath 22 due to chemical dissolution.

Referring to the FIGURE, an ion-exchange membrane 66 in the electrowinning cell 40 preferably separates the anode 60 from the bath 42. This is particularly important when the plating solution is a chloride solution. The ion-exchange membrane 66 permits the flow of electrons from the cathode 62 to the anode 60, but prevents chloride ions in the plating solution from contacting the anode and generating chlorine.

From the above description of a preferred embodiment of the invention, those skilled in the art will perceive improvements, changes and modifications. Such improvements, changes and modifications within the skill of the art are intended to be covered by the appended claims.

Having described the invention, the following is claimed:

1. A process for electroplating metals in an electroplating cell which comprises a bath containing a plating solution of a metallic salt, a cathode comprising a workpiece to be plated, and a soluble anode, in which the anode current efficiency of the cell is greater than the cathode current efficiency and the anode is soluble in the plating solution, said process comprising the steps of:

(i) providing an electrowinning cell which includes at least one insoluble anode, at least one cathode, and a bath which communicates with the bath of said electroplating cell (ii) connecting a source of direct electric current across the anode and cathode of said electroplating cell so as to cause electroplating of metal onto said workpiece;

(iii) circulating said plating solution between said cells;

(iv) connecting a source of direct electric current across said anode and cathode of the electrowinning cell; and (v) controlling said current so as to cause deposition of metal from said plating solution onto said cathode at a rate effective to compensate for both (a) the difference in current efficiencies between the anode and cathode in the electroplating cell and (b) the chemical dissolution of the anode in the electroplating cell.

2. The process of claim 1 wherein the amount of current ($I_w$) flowing through the electrowinning cell which results in the deposition of metal in the electrowinning cell is controlled in accordance with the following equation (2):

$$I_w = \frac{[I_p \times (E_e - E_p)] + I_c}{E_w} \quad (2)$$

wherein:

$I_p$=current (amp.) in the electroplating cell;

$E_e$=anodic efficiency in the electroplating cell;

$E_p$=cathodic efficiency in the electroplating cell;

$E_w$=cathodic efficiency in the electrowinning cell; and $I_c$=theoretical current required in the electrowinning cell to remove from the electroplating bath metal dissolved due to chemical corrosion of the anode in the electroplating bath, the values $E_e$, $E_p$ and $E_w$ being expressed in decimal fractions, the value $I_c$ being determined from the following equation (3):

$$I_c = \frac{G_{me}}{T} \times \frac{n \times F}{MW} \quad (3)$$

wherein:

$G_{me}/T$=grams of metal dissolved due to chemical corrosion of the anode in the electroplating cell per second n=valence of the metal F=Faraday's constant MW=Molecular weight of the metal dissolved.

3. The process of claim 2 for electrogalvanizing wherein the amount of current ($I_w$) flowing through the electrowinning cell which results in the deposition of metal in the electrowinning cell is controlled in accordance with the following equation:

$$I_w = \frac{[I_p \times (E_e - E_p)] + \left[\frac{\text{kg}}{\text{hr}} \times 820\right]}{E_w}$$

4. The process of claim 3 wherein said electroplating bath is a zinc chloride solution or a zinc sulfate solution.

* * * * *